US009188092B2

(12) United States Patent
McAvey et al.

(10) Patent No.: US 9,188,092 B2
(45) Date of Patent: Nov. 17, 2015

(54) FUEL TRANSFER SYSTEM

(71) Applicant: McAvey Ventures LLC, Ridgewood, NJ (US)

(72) Inventors: Michael McAvey, Ridgewood, NJ (US); Christian McAvey, Ridgewood, NJ (US); Matthew P. Meissner, Ridgewood, NJ (US); Mark L. Foyil, Hillsborough, NJ (US)

(73) Assignee: McAvey Ventures LLC, Ridgewood, NJ (US)

( * ) Notice: Subject to any disclaimer, the term of this patent is extended or adjusted under 35 U.S.C. 154(b) by 230 days.

(21) Appl. No.: 13/753,199

(22) Filed: Jan. 29, 2013

(65) Prior Publication Data

US 2013/0139917 A1 Jun. 6, 2013

Related U.S. Application Data

(63) Continuation-in-part of application No. 12/523,397, filed as application No. PCT/US2008/085383 on Dec. 3, 2008, now Pat. No. 8,360,115.

(60) Provisional application No. 60/991,815, filed on Dec. 3, 2007.

(51) Int. Cl.
*F02M 37/00* (2006.01)

(52) U.S. Cl.
CPC ..... *F02M 37/0088* (2013.01); *Y10T 137/87177* (2015.04)

(58) Field of Classification Search
CPC ..... B67D 7/54; B67D 7/58; B67D 7/72
USPC ..... 141/59, 67, 94, 192, 231, 285
See application file for complete search history.

(56) References Cited

U.S. PATENT DOCUMENTS

| | | | | |
|---|---|---|---|---|
| 2,048,387 | A | | 7/1936 | Johnsen |
| 3,603,481 | A | | 9/1971 | Dilger et al. |
| 3,916,929 | A | | 11/1975 | Brown |
| 3,927,797 | A | | 12/1975 | Flider |
| 3,940,002 | A | | 2/1976 | Schiemann |
| 4,064,901 | A | | 12/1977 | Bailey |
| 4,197,883 | A | | 4/1980 | Mayer |
| 4,311,261 | A | | 1/1982 | Anderson et al. |
| 4,349,042 | A | | 9/1982 | Shimizu |
| 4,602,599 | A | | 7/1986 | Glagola |
| 4,675,780 | A | | 6/1987 | Barnes et al. |
| 4,747,429 | A | * | 5/1988 | Sundstrom, Jr. ..... 137/351 |
| 4,781,314 | A | | 11/1988 | Schoonover et al. |
| 5,092,294 | A | * | 3/1992 | Jackson ..... 123/198 C |
| 5,135,258 | A | | 8/1992 | Buxton |
| 5,154,978 | A | | 10/1992 | Nakayama et al. |

(Continued)

OTHER PUBLICATIONS

International Search Report; PCT/US2008/085383 (Feb. 13, 2009).

*Primary Examiner* — Timothy L Maust
(74) *Attorney, Agent, or Firm* — Brinks Gilson & Lione

(57) ABSTRACT

A fuel transfer system for use with a motor vehicle of the type having a fuel tank and a fuel sending unit in the fuel tank for pumping fuel thorough a fuel line to the vehicles engine when the engine is idling where the fuel transfer system allows fuel in the fuel tank to also be delivered to an auxiliary fuel vessel such as another fuel tank, a fuel container, or an engine powered machine is provided. Embodiments of the present invention include features for draining the fuel transfer system when it is not in use for filling an auxiliary fuel vessel.

31 Claims, 14 Drawing Sheets

(56) References Cited

U.S. PATENT DOCUMENTS

| | | | | |
|---|---|---|---|---|
| D340,640 | S | 10/1993 | Ferguson et al. | |
| 5,267,670 | A | 12/1993 | Foster | |
| 5,280,806 | A | 1/1994 | Glazebrook | |
| D346,113 | S | 4/1994 | Ferguson et al. | |
| D358,330 | S | 5/1995 | Kahl | |
| 5,694,988 | A | 12/1997 | Collins | |
| 5,718,260 | A * | 2/1998 | Leonardi | 137/355.16 |
| 6,056,168 | A | 5/2000 | Owen, Jr. | |
| D433,635 | S | 11/2000 | Chrisco et al. | |
| D434,328 | S | 11/2000 | Chrisco et al. | |
| 6,167,903 | B1 * | 1/2001 | Newman | 137/351 |
| 6,283,320 | B1 | 9/2001 | Patch | |
| 6,371,159 | B1 | 4/2002 | Timberlake | |
| 6,501,357 | B2 | 12/2002 | Petro | |
| 6,505,699 | B1 | 1/2003 | Christini et al. | |
| 6,591,864 | B1 | 7/2003 | Denby | |
| 6,637,466 | B2 * | 10/2003 | Mills, Jr. | 141/1 |
| 6,648,012 | B2 | 11/2003 | Linthorst | |
| 6,792,966 | B2 | 9/2004 | Harvey | |
| 6,848,481 | B1 * | 2/2005 | Bay et al. | 141/65 |
| 6,938,612 | B2 * | 9/2005 | Porter | 123/509 |
| D528,423 | S | 9/2006 | Glover | |
| 7,255,190 | B1 | 8/2007 | Floro | |
| 7,255,323 | B1 | 8/2007 | Kadhim | |
| 7,487,796 | B2 | 2/2009 | Imler et al. | |
| D606,162 | S | 12/2009 | McAvey et al. | |
| 8,360,115 | B2 * | 1/2013 | Trattner et al. | 141/59 |
| 8,695,645 | B2 | 4/2014 | McAvey et al. | |
| 2004/0221920 | A1 | 11/2004 | Ferguson et al. | |
| 2008/0011743 | A1 | 1/2008 | Edwards | |
| 2009/0159823 | A1 | 6/2009 | Matsunaga et al. | |
| 2009/0179049 | A1 | 7/2009 | Drummond | |
| 2010/0101659 | A1 | 4/2010 | Trattner et al. | |
| 2010/0225104 | A1 | 9/2010 | Ully et al. | |
| 2013/0139917 | A1 | 6/2013 | McAvey | |
| 2013/0174914 | A1 | 7/2013 | McAvey et al. | |
| 2013/0199661 | A1 | 8/2013 | McAvey et al. | |
| 2014/0259436 | A1 | 9/2014 | McAvey | |
| 2014/0260651 | A1 | 9/2014 | McAvey | |
| 2014/0290787 | A1 | 10/2014 | McAvey | |

* cited by examiner

FUEL TRANSFER SYSTEM

CROSS REFERENCE TO RELATED APPLICATIONS

This application is a Continuation-in-Part application of U.S. patent application Ser. No. 12/523,397 filed on Jul. 16, 2009 and issued on Jan. 29, 2013 as U.S. Patent 8,360,115, which is the National Stage of PCT/US08/85383 filed on Dec.3, 2008 , which claims the benefit of U.S. Provisional Application Ser. No. 60/991,815 filed on Dec. 03, 2007 The entire contents of these applications are incorporated herein by reference.

FIELD OF THE INVENTION

This invention relates generally to systems and methods for transferring a fluid from a main reservoir to a receiving reservoir. More particularly, this invention relates to systems and methods for transferring a liquid fuel from a motor vehicle's fuel tank to an auxiliary fuel tank.

BACKGROUND OF THE INVENTION

Vehicles, machines, and equipment powered by combustion engines find wide use in a variety of applications. Examples of such vehicles, machines, and equipment include snow blowers, riding tractors, off-road vehicles, electrical generators, motorcycles, snowmobiles, landscaping equipment, and lawn mowers, among others. There continually exists a need to be able to fill the fuel tanks of these vehicles, machines, and equipment in a safe and environmentally friendly manner. Many times it is necessary to transfer fuel to these vehicles, machines, and equipment when they require fueling at a location that is a substantial distance from a fueling station. This filling operation is conventionally accomplished by either transporting the vehicle, machine, or equipment to the fueling station or by bringing a heavy portable container of gas from the fueling station to the vehicle, machine, or equipment. Both of these options suffer from multiple drawbacks. First, transporting a vehicle, machine, or piece of equipment to a fueling station can be time consuming and costly. Second, transporting a portable fuel container from the fueling station to the vehicle, machine, or equipment is ergonomically difficult for the operator, as well as being both environmentally unfriendly due to the possibility that a spillage or accident could occur and a health hazard due to the dangers associated with siphoning.

Accordingly, there exists a continual need to provide a more effective means of transferring fuel to vehicles, machines, and equipment that have run out of fuel during use or operation.

SUMMARY OF THE INVENTION

The present invention provides fuel transfer systems for use with a motor vehicle of the type having a fuel tank and a fuel sending unit in the fuel tank for pumping fuel thorough a fuel line to the vehicle's engine. The fuel transfer systems and methods of this invention allow fuel in the fuel tank to be delivered to an auxiliary fuel vessel such as another fuel tank, a fuel container, or an engine powered machine. One embodiment of a fuel transfer system, constructed in accordance with the teachings of the present invention, generally comprises a fueling nozzle having a flow control valve for delivering the fuel to the auxiliary fuel vessel. The fueling nozzle may have a boot assembly used for capturing splashed fuel from the auxiliary fuel vessel. The fuel transfer system also has a fuel fitting in the fuel line that provides a fuel flow path from the fuel line to the fuel transfer system. A first fuel conduit is connected to the fuel fitting and in communication with the enclosure. The fluid transfer system further has a fuel valve that communicates with the first fuel conduit for controlling the flow of fuel in the fuel transfer system and a flow regulator connected with the first fuel conduit for controlling flow of the fuel delivered by the fueling nozzle. The flexible, second fuel conduit is in communication with the first conduit at the enclosure and to the fueling nozzle.

According to one aspect of the present invention, the fuel transfer system including the fueling nozzle, fuel fitting, first fuel conduit, enclosure, fuel valve, pressure regulator and flexible, second fuel conduit is electrically connected and grounded to the vehicle.

According to another aspect of the present invention, the fuel transfer system may further comprise a control panel mounted to the vehicle having an on-off switch connected to the vehicle's power supply and the fuel sending unit for providing power to the fuel sending unit when the vehicle's engine is not running. The on-off switch when activated is timed or set to turn off at a predetermined interval.

Another objective of the present invention is to provide a fuel fitting for connecting the fuel line between a vehicle's fuel tank and engine to a fuel transfer system that can deliver fuel to an auxiliary fuel vessel. The fuel fitting generally comprises a T-shape or Y-shape three-way fitting having three coupled ends. One end of the fitting is coupled to the portion of the vehicle's fuel line that is connected to the engine. A second end of the fitting is coupled to the portion of the vehicle's fuel line that is connected to the fuel tank. The third end is coupled to the first fuel conduit of the fuel transfer system used to deliver fuel to the auxiliary fuel vessel through a fuel transfer system that includes a first fuel conduit, an enclosure, a fuel valve, a flow regulator, a flexible second fuel conduit, and a fueling nozzle.

Another objective of the present invention is to provide a fuel transfer system for use with a motor vehicle of the type having a fuel tank, a fuel sending unit in the fuel tank for pumping fuel thorough a fuel line to the vehicle's engine, and a vapor recovery system for collecting fuel vapor in the fuel tank. In this embodiment, the fuel transfer system also allows fuel in the fuel tank to be delivered to an auxiliary fuel vessel such as another motor vehicle, a fuel container, or an engine powered machine. According to one aspect of this embodiment, the closed loop fuel transfer system comprises a fueling nozzle having a flow control valve for delivering the fuel to the auxiliary fuel vessel. The fueling nozzle may have a boot assembly for capturing not only splashed fuel but also fuel vapor from the auxiliary fuel vessel.

The fuel transfer system of this embodiment also includes an enclosure mounted to the vehicle and a fuel fitting in the fuel line providing a fuel flow path from the fuel line to the fuel transfer system. A first fuel conduit is connected to the fuel fitting and in communication with the enclosure. A pressure regulator is connected with the first conduit for controlling pressure of the fuel delivered by the fueling nozzle, while a manual fuel valve or an electrically controlled fuel valve communicates with the first conduit for controlling the flow of fuel in the fuel transfer system. A flexible second fuel conduit is in communication with the first conduit at the enclosure and to the fueling nozzle. A first vapor line fitting is attached to the vehicle vapor recovery system and to the enclosure, with a second vapor line being coupled with the first vapor line at the enclosure and to the fueling nozzle's boot assembly. Finally, an electronic control system may be used for controlling the fuel valve wherein opening of the fuel valve enables fuel to flow through the fuel transfer system to the fueling nozzle to supply the fuel to the auxiliary fuel vessel. The boot assembly collects splashed fuel and sends fuel vapor to the vehicle vapor recovery system.

Further embodiments of the present invention provide systems and methods wherein the fuel transfer system includes features for draining fuel from the system when it is not in use for auxiliary fueling activities. In this manner, residual fuel is not left in the system in a manner which can become an exposure hazard or a factor in vehicle crash injury mitigation. Features are also provided for isolating the auxiliary fuel system such that a component failure in that system does not impair the operation of the associated motor vehicle.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE INVENTION

Figure 1A:
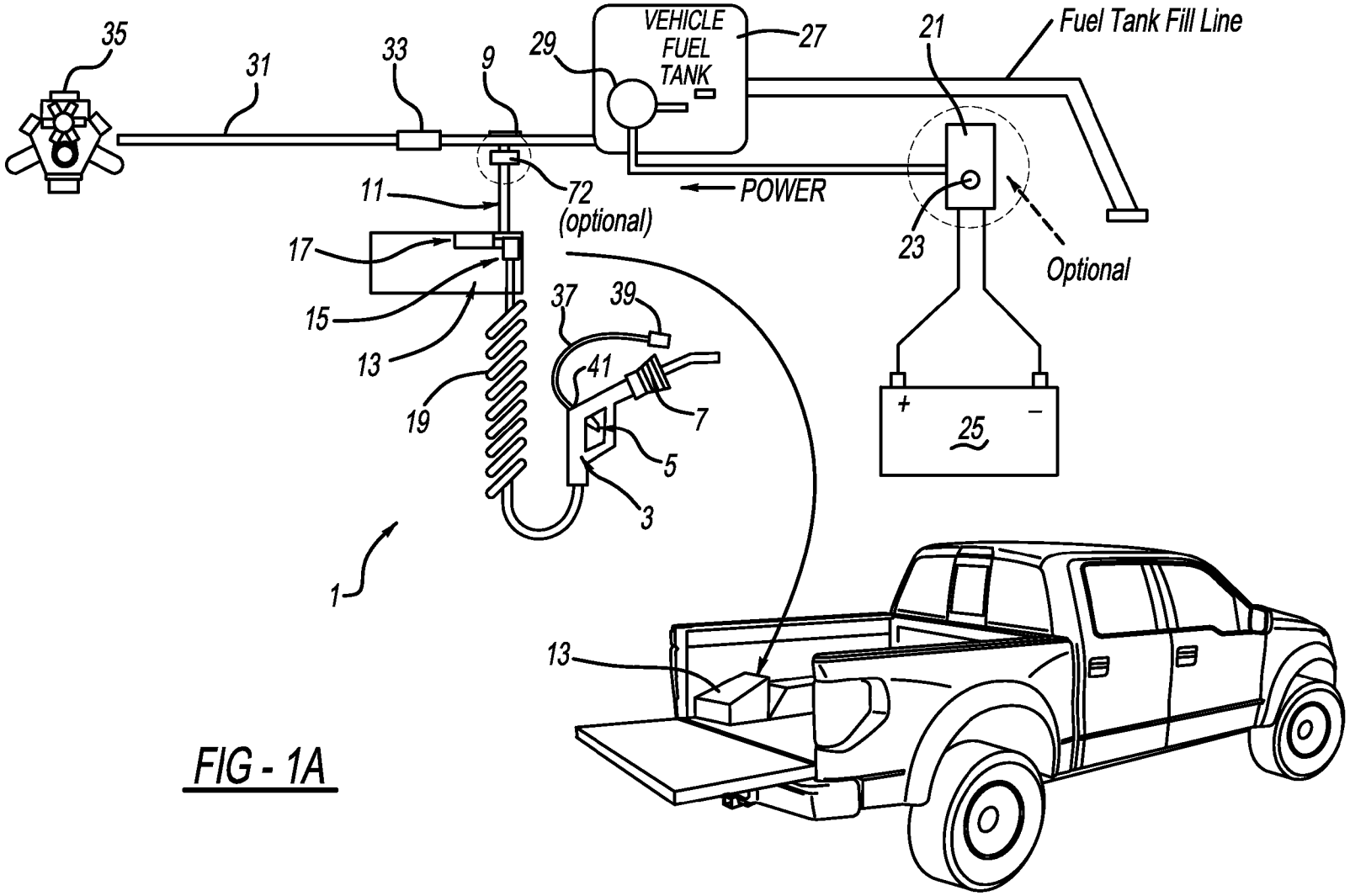
FIG. 1A is a schematic of a fuel transfer system according to a first embodiment of the present invention.

The following description is merely exemplary in nature and is in no way intended to limit the present disclosure or its application or uses. It should be understood that throughout this description and drawings, corresponding reference numerals indicate like or corresponding parts and features.

Referring to FIG. 1A, the present invention generally provides a fuel transfer system 1 for use with a motor vehicle of the type having a fuel tank 27 and a fuel sending unit 29 in the fuel tank 27, which includes an electric motor driven fuel pump, for pumping fuel thorough a fuel line 31 to the vehicle's engine 35 for supplying the engine. The fuel transfer system 1 allows fuel in the fuel tank 27 to also be delivered to an auxiliary fuel vessel (not shown) such as another fuel tank, a fuel container, or an engine powered machine. The fuel transfer system 1 generally comprises a fueling nozzle 3 having a flow control valve 5 for delivering the fuel to the auxiliary fuel vessel (not shown). The fueling nozzle 3 has a boot assembly 7 for capturing splashed fuel and vapor from the auxiliary fuel vessel. A fuel fitting 9 in the fuel line 31 provides a fuel flow path from the fuel line 31 to the fuel transfer system 1A. A first fuel conduit 11 is connected with the fuel fitting 9 and in communication with an enclosure 13. The fuel transfer system 1 has a fuel valve 15 communicating with the first fuel conduit 11 for controlling the flow of fuel in the fuel transfer system 1 and a flow valve-regulator 17 connected with the first fuel conduit 11 for controlling the flow rate of the fuel delivered by the fueling nozzle 3. Valve 15 can be in the form of a one-way check valve or as a manually or remotely controlled on-off fuel valve. If desired, such valve 15 and/or regulator 17 may be included within the enclosure 13 or formed as part of a unitized valve providing both on-off control and flow rate regulation. When the engine 35 of the vehicle is running (e.g., idling, etc.) the control of fuel is partially diverted from the fuel line 31 to the fuel transfer system 1 in such a manner that will not cause the engine 35 to stall or stop running by starving it of fuel. The fuel transfer system 1 further comprises a flexible, second fuel conduit 19 coupled to the first conduit 11 at the enclosure 13 and to the fueling nozzle 3. The fuel fitting 9 may be connected to the fuel line 31 at a location between the fuel tank 27 and the in-line fuel filter 33 (or after the filter). Optionally, the enclosure 13 of the fuel transfer system 1 may be mounted to the vehicle, such as in the trunk or, if a pick-up truck, in the bed of such truck. The enclosure 13 may include a holder for the fueling nozzle 3 that is vented externally through the use of a drip tube or other feature.

Figure 1B:
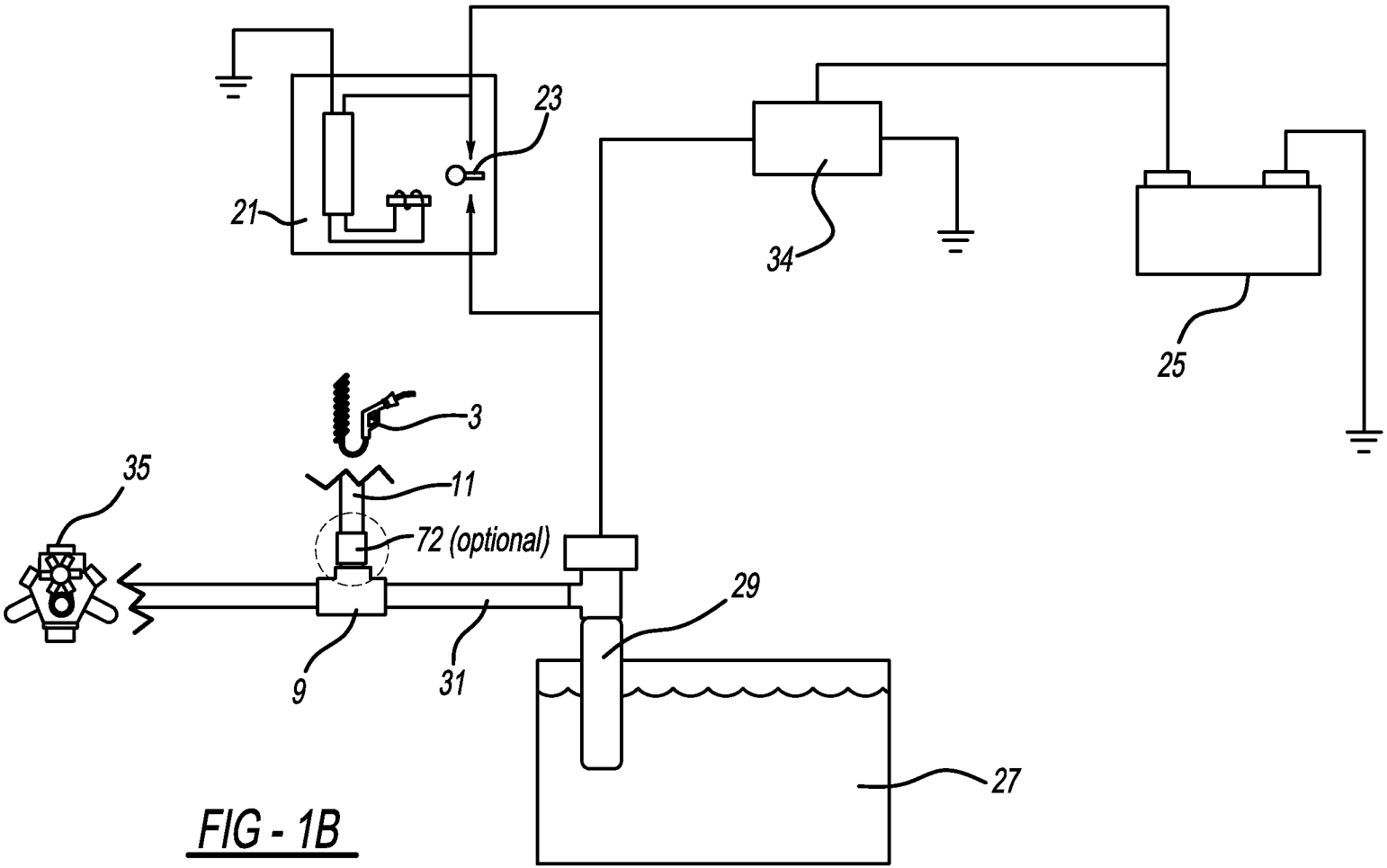
FIG. 1B is a schematic further depicting the optional electronic control for the fuel transfer system of FIG. 1A.

The fuel transfer system 1 is an easy to install system that allows the end-user to transfer liquid fuel (e.g., gasoline, E85, E95, diesel fuel, or other liquid fuel) directly from a host motor vehicle's fuel tank 27 to the fuel tank of auxiliary equipment or vehicles, or a portable fuel container. The fuel fitting 9 may be coupled to the fuel line 31 using connectors or couplings that are compatible with existing fuel lines. In the embodiment as shown in FIGS. 1A and 1B, fuel is delivered from the host vehicle's fuel tank 27 to an auxiliary fuel tank by activating the vehicles OEM fuel sending unit 29 located inside the fuel tank 27 and drawing fuel directly from the vehicle's fuel tank 27 and passing it through the fuel fitting 9 that connects directly to the first conduit 11 of the fluid transfer system 1. The fuel then passes through the enclosure 13 to a bulkhead fitting on/off fuel valve-regulator 17, a fuel valve 15, and finally through the flexible, second conduit 19, which is connected directly to a nozzle assembly 3 used for final delivery to the auxiliary fuel tank. The nozzle assembly 3 has its own flow controlled valve 5 which is preferably a spring loaded mechanical type, which is depressed in order for the fuel to flow out of the nozzle assembly 3. Optionally, a manual on-off ball valve or solenoid valve 72 may be located after the fuel fitting 9 in order to control the flow of fuel to the first conduit 11.

According to an optional aspect of the present invention shown in FIGS. 1A and 1B, the fuel transfer system 1 may be operated without turning the vehicle's engine on. In this aspect of the present invention, the system may be activated from a control panel 21 mounted to the vehicle having an on-off switch 23 connected directly to the vehicle's power supply (i.e., battery) 25 and the fuel sending unit 29 for providing power to the fuel sending unit 29 when the vehicle's engine is not running. The control panel 21 is preferably in communication with the vehicle's onboard computer 34 (shown in FIG. 2B). The on-off switch 23, which is preferably a single-pole double-throw (SPDT) automatic relay, is timed or set to turn off at a predetermined interval after activation. Optionally, the control panel 21 may include an audible or visible alarm that activates prior to or upon automatic shutdown. This timed function with a predetermined interval is beneficial in that accidently leaving the on-off switch in the on position will not cause the vehicle's battery system 25 to be drained. In addition, this automatic shut-off also provides some insurance against the auxiliary fuel vessel overflowing if the end-user is distracted or neglects to turn the switch 23 to its off position. A fuel transfer system 1 equipped with a control panel 21 allows an end-user without a driver's license access to fuel delivery without needing the keys to the vehicle's ignition. One skilled in the art will recognize that the predetermined interval can be set to any desired time. Preferably, the predetermined interval is for example about 2 minutes.

Figure 2:
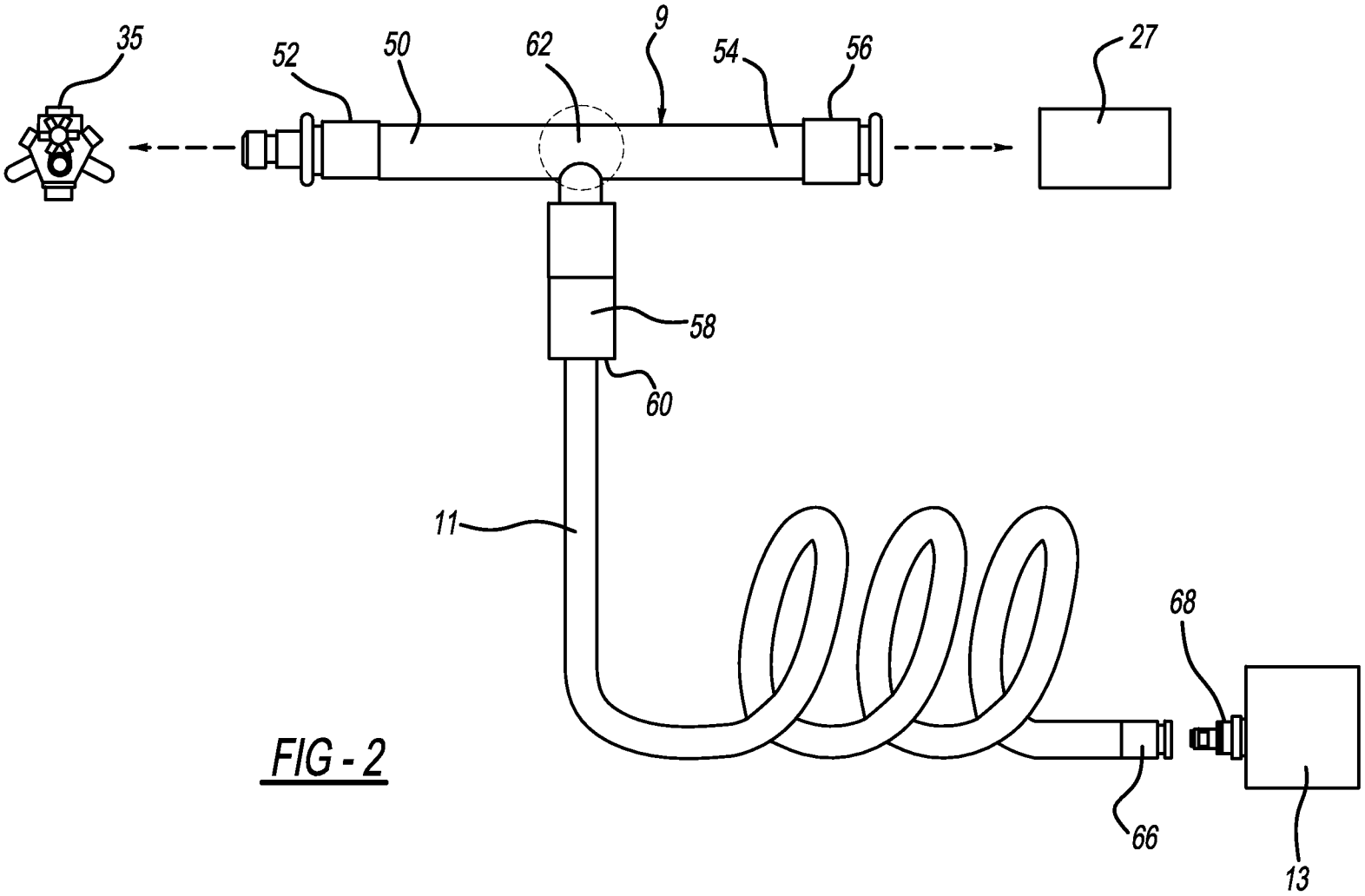
FIG. 2 is a schematic of a fuel fitting used in a fuel transfer system according to one aspect of the teachings of the present invention.

Another embodiment of the present invention generally relates to a fuel fitting for connecting the fuel line between a vehicle's fuel tank and engine to a fuel transfer system that can deliver fuel to an auxiliary fuel vessel. Referring to FIG. 2, the fuel fitting 9 generally comprises a T-fitting or a Y-fitting. The fuel fitting 9 comprises a first section 50, a second section 54, and a third section 58. The end 52 of the first section 50 is coupled to the portion of the vehicle's fuel line 31 that is connected to the engine 35. The end 56 of the second section 54 is coupled to the portion of the vehicle's fuel line 31 that is connected to the fuel tank 27. The end 60 of the third section 58 is coupled to the first fuel conduit 11 of the fuel transfer system 1 that is used to deliver fuel to the auxiliary fuel vessel. The first 50, second 54, and third 58 sections of the fuel fitting 9 are joined at a common intersection point 62.

The ends 52 and 56 of the fuel fitting 9 that couple to the fuel line 31 or to the first fuel conduit 11 of the fuel transfer system 1 preferably use a coupling selected as one from the group of a threaded or locked barb connection, a clamp, or a male or female quick-disconnect coupling. One skilled in the art will recognize that the connections between the various components in the fuel transfer system 1 can be of any type or form, including but not limited to those mentioned above. The couplings may be any type of connector that will mate with an existing connector or coupling used with the fuel line 31 or first fuel conduit 11, including but not limited to, couplings that meet standard SAE J2044 (Society of Automotive Engineers, Troy, Mich.) entitled "Quick Connector Specification for Liquid Fuel and Vapor/Emissions Systems."

The fuel transfer system 1 including the fueling nozzle 3, fuel fitting 9, first fuel conduit 11, enclosure 13, fuel valve 15, flow regulator 17 and flexible, second fuel conduit 19 are preferably electrically connected and grounded to the vehicle. This can be accomplished by having all of the components made out of a conductive material, such as a metal or having conductive fibers. When desirable, the body of the fuel fitting 9 may be comprised of a composite having a nylon inner layer and a rubber outer layer, the outer layer being adhered or clamped to the inner layer. The fuel fitting 9, as well as the flexible, second fuel conduit 19, may be inherently conductive when it is selected as one from the group of a conductive material (e.g., metal or conductive polymer, among others), a non-conductive material reinforced with conductive fillers, or a non-conductive material having a separate conductive element running the length of the conduit 19. The separate conductive element may be a conductive mesh of fibers or wires embedded within second fuel conduit 19 or fuel fitting 9. The second fuel conduit 19 may be comprised of multiple layers of different materials with the conductive element being located at the interface between two adjacent layers if desirable. Additionally, a grounding cable 37 that has a first end 41 and a second end 39 with the first end 41 being attached to the fueling nozzle 3 and the second end 39 being capable of engaging another grounded element may be used. For example, the second end 39 may include an alligator type clip that can be fastened to the frame of the auxiliary fuel tank, thereby assisting in making the entire fuel transfer system 1 electrically common or grounded.

Another unique feature of the fuel transfer system 1 is that the fuel can be delivered to an auxiliary fuel vessel in a metered, controlled manner. According to another embodiment of the present invention, when the nozzle 3 is inserted properly into the target fuel tank, the fuel transfer system 1 can form a completely sealed loop that ties back into the vehicle's existing vapor recovery system. The system 1A can be equipped with a safety timer that allows only a preset total amount of fuel to be delivered before automatically shutting down the vehicle's fuel sending unit 29 and the transfer system's 1 solenoid control valve. This allows the filling of auxiliary fuel tanks with significantly less environmental impact due to evaporation, vapor displacement, permeation and spillage than with traditional methods of refueling small engines or PFC's (Portable Fuel Containers).

Figure 3:
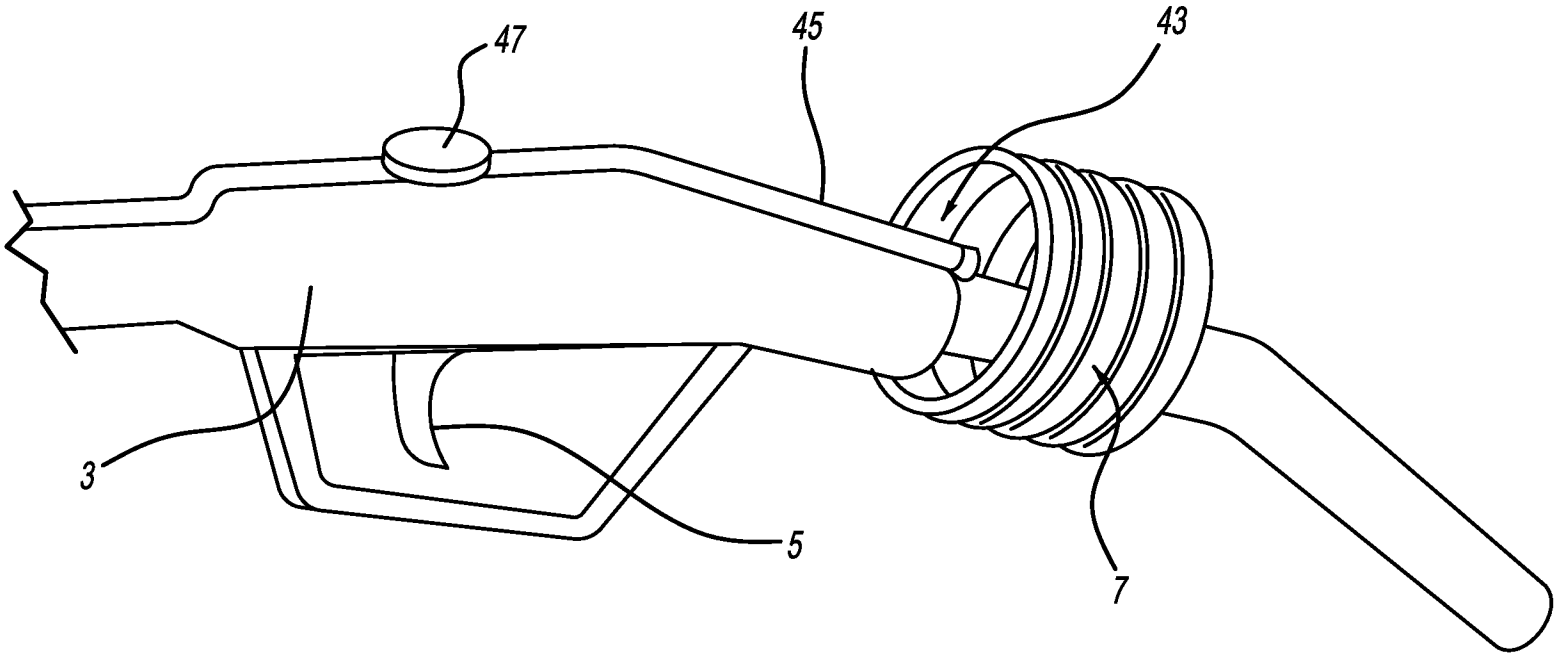
FIG. 3 is a schematic of a fueling nozzle assembly according to one aspect of the teaching of the present invention.

Referring to FIG. 3, the fuel transfer system 1 is preferably also equipped with a transparent recovery boot assembly 7 and clear polycarbonate panel 43 on the nozzle 3 that has the nozzle 3 placed asymmetrically toward the rear of the panel. This allows the operator a better sight line to see into the target fuel tank by looking directly through the front of the panel 43. This design will discourage the operator from breaking the vapor seal multiple times during filling, helping to minimize evaporative losses. In addition, the nozzle assembly 3 may further include a vapor recovery tube 45 connected through the clear panel 43 into the recovery boot 7.

Figure 4:
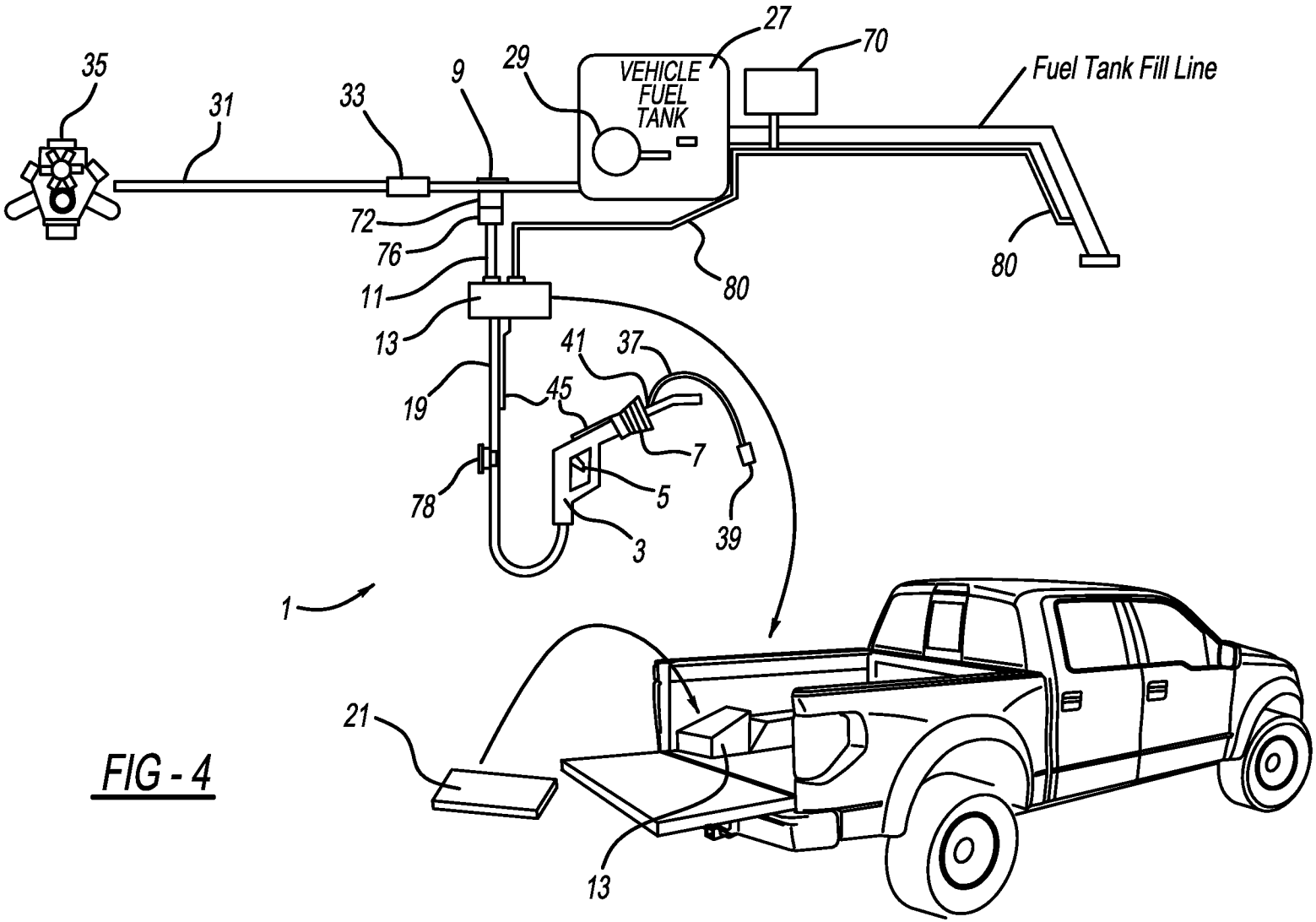
FIG. 4 is a schematic of a fuel transfer system according to a second embodiment of the present invention.

According to another aspect of the present invention as shown in FIG. 4, the fuel transfer system 1 may include the ability of vapor recovery by taking advantage of the already existing Onboard Refueling Vapor Recovery (ORVR) system 70 currently embedded in most newer motor vehicles. This allows refueling of target devices in the field to occur with the same attention to vapor recovery required (by EPA and/or CARB) for vehicles refueling at filling stations in many areas. In this embodiment, fuel is delivered to the auxiliary fuel tank by activating the vehicles OEM fuel sending unit 29 while simultaneously actuating a solenoid valve 72 (when installed) to allow fuel flow to through the fluid transfer system 1. This may be accomplished electronically by interfacing a control panel 21 directly to the vehicle's wiring harness between the on-board computer and fuel sending unit. The schematic and block diagram for the electrical system are shown in detail in FIGS. 5A and 5B. The control panel 21 is also equipped with a timer to preset the desired volume of fuel delivered. One skilled in the art will realize that the electrical system may be configured in any other manner in the art without deviating from the teachings of the present invention.

When activated, the OEM fuel sending unit 29 draws fuel directly from the vehicle's fuel tank 27 and passes it through the OEM fuel line 31. The fuel then enters fuel fitting 9 connected to a solenoid valve 72 and regulator 76 of the fuel transfer assembly 1 and inserted either just upstream of the vehicles OEM fuel filter 33 or just downstream of the fuel sending unit 29. This fuel fitting 9 may be a specially designed T-fitting that either threads directly into the upstream side of the vehicle's fuel filter 33 or connects directly to the downstream side of the fuel sending unit 29 using quick connect fitting. When the solenoid valve 72 is actuated, fuel exits the valve at about a 90° angle to the main fuel line and passes through the flow regulator 76, which limits the fuel flow rate in this auxiliary line. Fuel then flows through a (preferably) grounded first conduit 11 that is connected to the enclosure 13 via a bulkhead fitting. The fuel then passes into the fuel conduit 19 of a flexible coiled dual conduit hose, which in one embodiment forms to internal passageways (one for liquid fuel and another for vapor) which is connected to an inline volume meter 78. Fuel then flows through another section of grounded conduit 19 which is connected to the refueling nozzle 3. The nozzle 3 has its own spring loaded mechanical trigger operated valve 5, which must be depressed in order for fuel to flow out of the nozzle.

When the nozzle assembly 3 is properly inserted into the target fuel tank, it forms a tight seal. This seal forces the vapor laden air which is exiting the target fuel tank into a small penetration through the clear polycarbonate plastic boot panel 43. This penetration may be connected by a tube 45 to the vapor recovery valve 47. As mentioned previously second conduit 19 may have a dual lumen or a separate conduit tube 45 may be provided separated from or connected with tube 45. The vapor recovery tube 45 is connected back to the enclosure 13 by a second bulkhead fitting. The bulkhead fitting is then connected to a vapor recovery line 80 that ties back into the vehicle's OEM vapor recovery system 70. The connection to the ORVR 70 is made by simply placing a barbed T-fitting into the existing vapor recovery hose that originates from the neck of the vehicle's fuel tank. An additional grounding cable 37 of a specific length is attached directly from the fueling nozzle 3 to a preferably spring loaded alligator clip forming second end 39. When properly fastened to the frame of the auxiliary fuel tank, this ground ensures electrical neutrality throughout the fuel transfer system 1.

Figure 6:
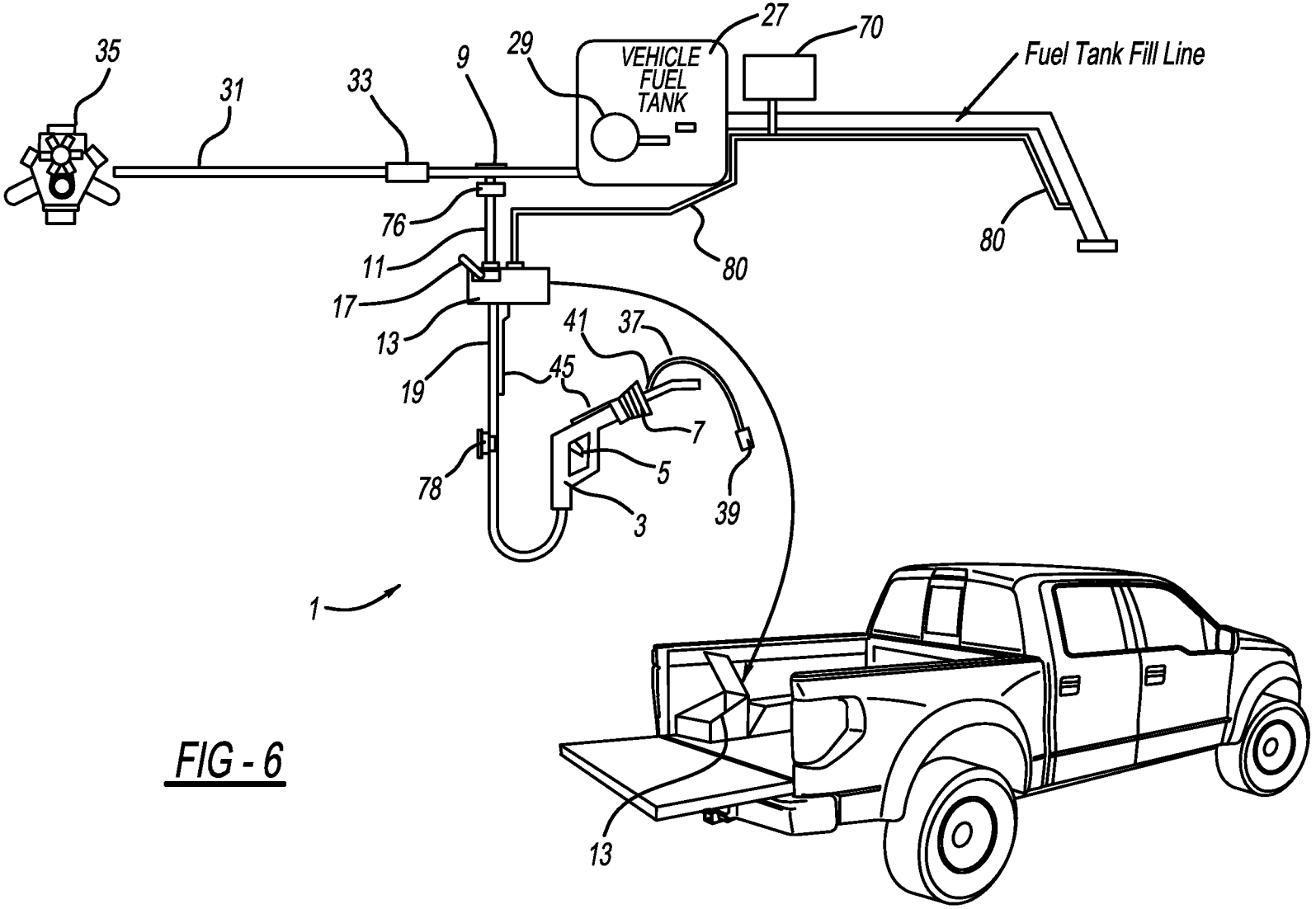
FIG. 6 is a schematic of a fuel transfer system according to a third embodiment of the present invention.

According to another aspect of this embodiment, as shown in FIG. 6 fuel can be delivered to the auxiliary fuel tank while the vehicle idles; this is accomplished by mechanically actuating an ON/OFF valve 15 that is integrated into the enclosure 13. When the fuel transfer system 1 is in use, the OEM fuel sending unit 29 draws fuel directly from the host vehicle's fuel tank 27 and passes it through the OEM fuel line 31. The fuel then enters a custom T-fitting 9 with a pressure regulator 76 assembly inserted either just upstream of the vehicles OEM fuel filter 33 or just downstream of the fuel sending unit 29. This assembly consists of a specially designed T-fitting 9 that either thread directly into the upstream side of the vehicles fuel filter 33 or connects directly to the fuel sending unit 29 using quick connect fitting. Fuel flows through the T-fitting 9 at about a 90° angle to the main fuel line and then passes through a pressure regulator 76 which limits the fuel flow rate in this auxiliary line. Fuel then flows through a preferably grounded conduit 11 that is connected to an ON/OFF valve 15 located after the bulkhead fitting on the inside of the enclosure 13. Fuel exiting the valve then passes into the large fuel conduit of flexible coiled dual passageway conduit 19 which is connected to an inline volume meter 78. It then flows through another section of grounded conduit 19 which is connected to the fueling nozzle 3. The nozzle 3 has its own spring loaded mechanical trigger 5, which must be depressed in order for fuel to flow out of the nozzle.

When the nozzle 3 and optional boot assembly 7 is properly inserted into the target fuel tank, it forms a tight seal. This seal forces the vapor laden air which is exiting the auxiliary fuel tank into a small penetration through the clear polycarbonate plastic boot panel 43. This penetration is connected by a vapor recovery tube 45 to the vapor recovery valve 47. This valve 47 connects directly to the vapor recovery line, which is the smaller of the two conduits on the dual conduit hose 19, is connected back to the enclosure 13 by a bulkhead fitting. The bulkhead fitting is then connected to a vapor recovery hose 80 that ties back into the vehicles OEM Onboard Refueling Vapor Recovery (ORVR) system 70. The connection to the ORVR 70 is made by simply placing a barbed T-fitting into the existing vapor recovery hose 80 that originates from the neck of the vehicle's fuel tank 27. An additional grounding cable 37 of a specific length is attached directly from the fueling nozzle 3 to a spring loaded alligator clip 39. When properly fastened to the frame of the auxiliary fuel tank, this ground ensures electrical neutrality throughout the fuel transfer system 1.

For safety purposes, the ON/OFF valve 15 may be purposely oriented so that its handle protrudes outside the enclosure 13 whenever it's in the open "ON" position. In this way, the operator cannot close the enclosure 13 until they close the ON-OFF valve 15.

Figure 5A:
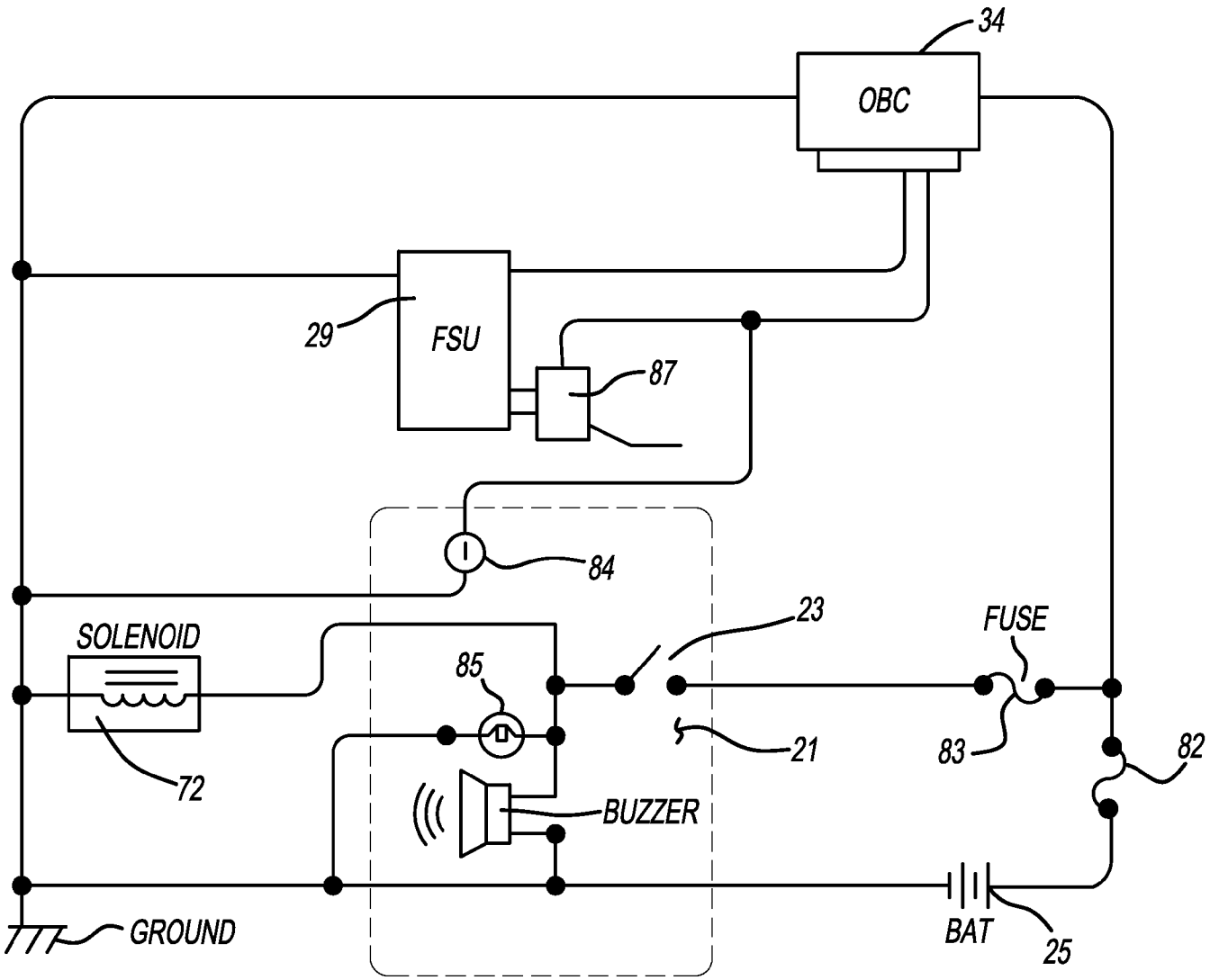
FIG. 5A is a schematic of the electrical system used with a fluid transfer system according to one embodiment of the present invention.
Figure 5B:
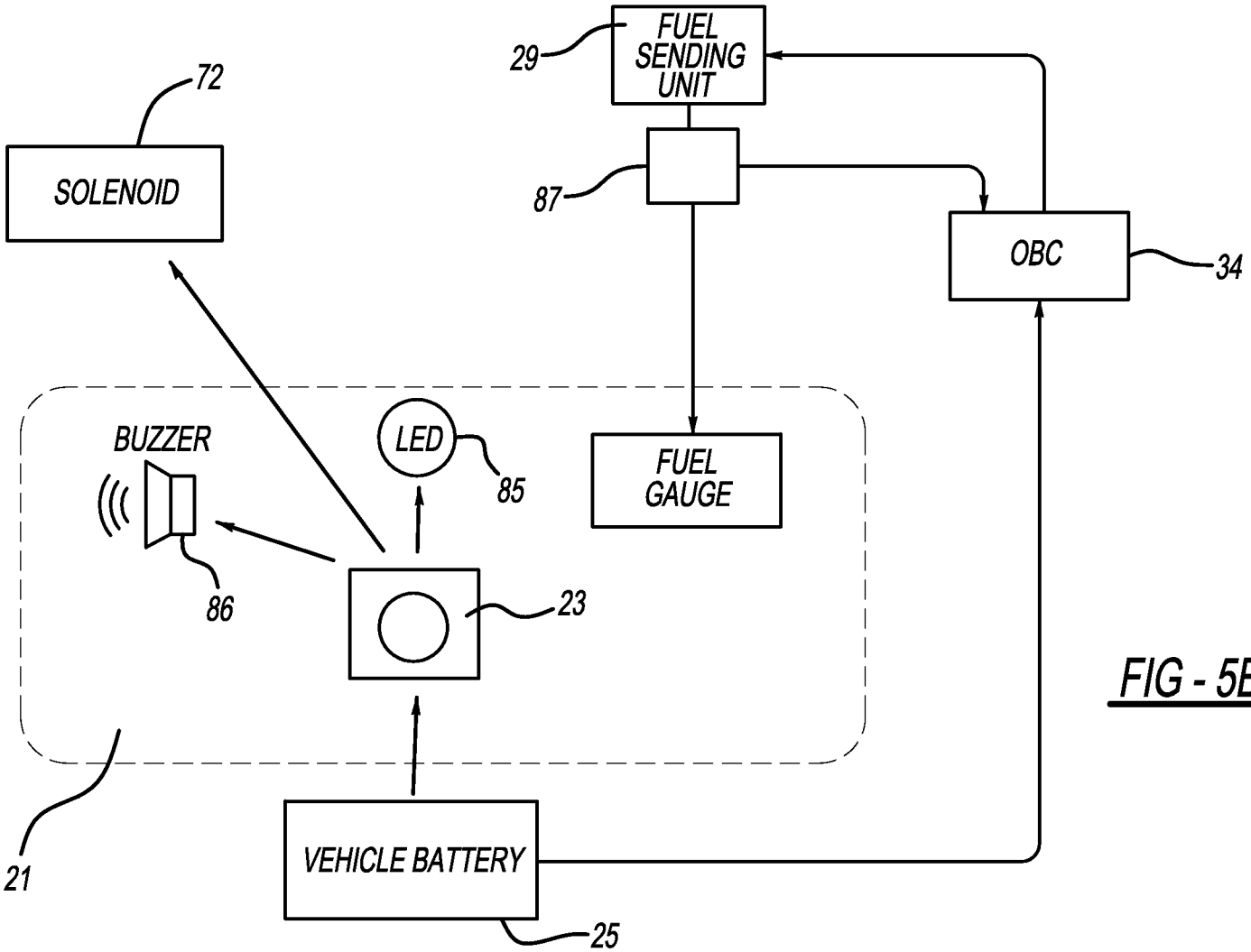
FIG. 5B is block flow diagram of the electrical system of FIG. 5A.

FIGS. 5A and 5B illustrate simplified electrical diagrams for fuel transfer system 1. Referring particularly to FIG. 5A the circuit is shown in which battery 25 supplies electrical power to onboard computer 34 through fuse 82. Electrical power is also supplied through the fuse 83 to control panel 21. Power is switched through on-off switch 23 to activate solenoid valve 72 which will allow fuel flow into system 1. Power lamp 84 indicates to a user that the system 1 is supplied with electrical power. When on-off switch 23 is closed, electrical power is also provided to illuminate LED 85 and optional buzzer 86 which provides an audible indication of operation of the system. This diagram also shows fuel level sender 87. FIG. 5B provides another representation of the electrical components and their relationship. Onboard computer 34 may be programmed to deny operation of fuel transfer system 1 in the event that the fuel level detected by fuel level sender 87 indicates a low fuel condition.

Figure 7:
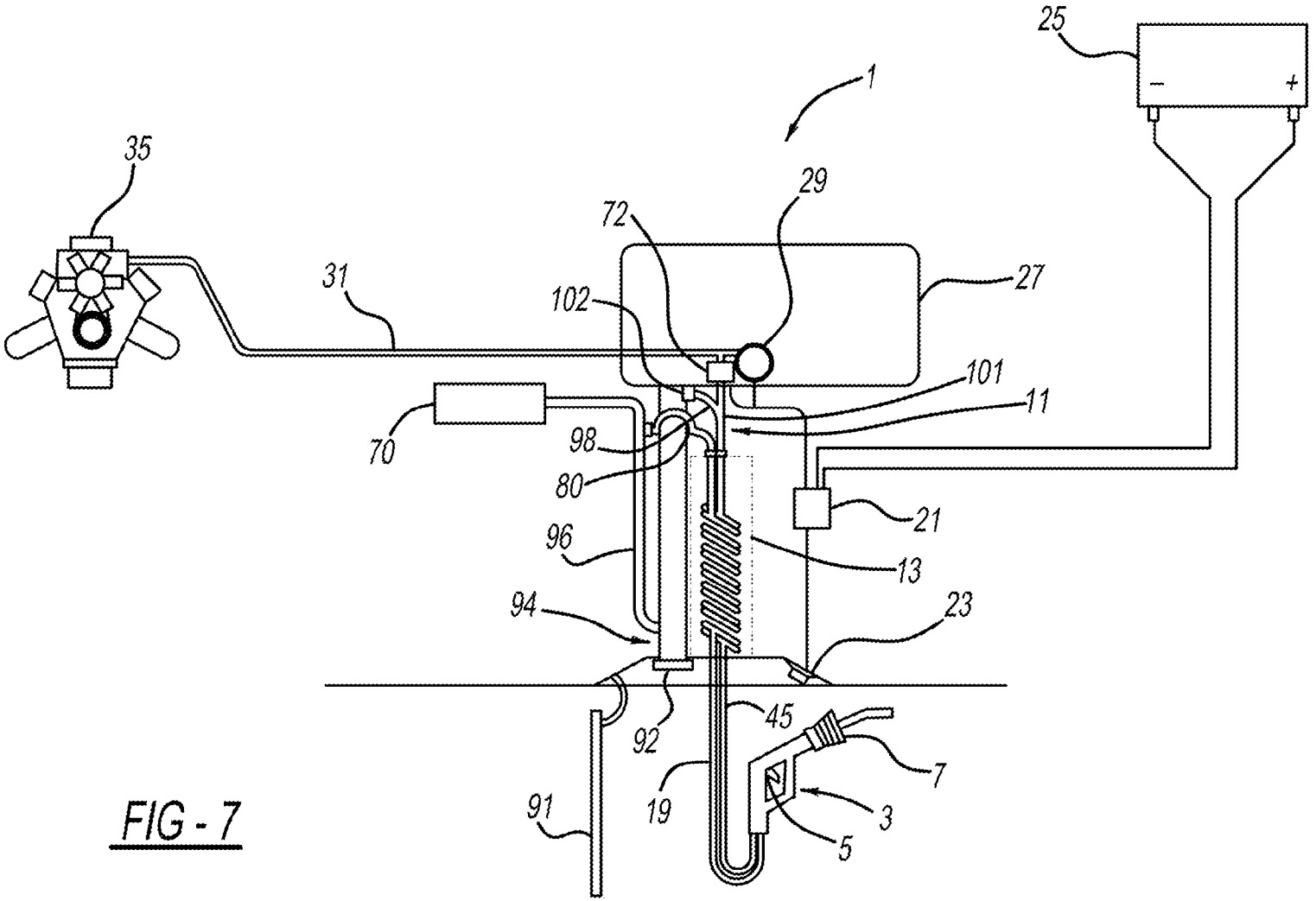
FIG. 7 is a schematic of a fuel transfer system according to a fourth embodiment of the present invention.

Now with reference to FIG. 7, a fourth embodiment of the fuel transfer system 1 is illustrated. The embodiments illustrated by FIGS. 7 through 11 provide the benefit that fuel within the fuel transfer system 1 can be drained from the fuel flow conduits 11 and 19 such that liquid fuel, or at least an appreciable amount of such liquid fuel, is not retained in the system 1 after it is used for an auxiliary fueling operation. These features provide benefits in reducing the quantity of fuel that is subject to diffusion or evaporation remaining in the system, and may address crash safety factors associated with such retained fuel. The system embodiments shown in FIGS. 7 through 12 illustrate components provided for filling fuel tank 27 with fuel, typically done by the vehicle operator at periodic stops at motor vehicle fuel filling stations. Motor vehicles using traditional liquid fuels incorporate a fuel filling system which allows liquid fuel flowing from a filling nozzle to flow into fuel tank 27. Typically the fuel filling system incorporates filler neck 94 with associated components as described below.

In several of the embodiments described below, fuel remaining in the system 1 is returned to fuel tank 27 through a fuel return path. A fuel return path may include the fuel filling system mentioned previously which is used by the operator for filling their fuel tank 27. However, a fuel return path could also include any system connected with fuel tank 27 which permits a return of fuel from the system 1. For example, fuel can be returned through a dedicated conduit communicating with the fuel tank 27, not directly connected with the fuel filling system. Another example would be making a fuel return path through a return line which allows fuel to return to the fuel tank 27 from a fuel injection system of the engine 35. The return path may also be draining fuel retained in the system 1 into an auxiliary fuel vessel until the system is filled with gas such as air. In this specification, a fuel return path may include any of the aformentioned approaches toward returning fuel residing in the system 1 back to the fuel tank 27 or another vessel to reduce the quantity of fuel stored in the system 1 after it is used for providing auxiliary fueling.

Fuel transfer system 1 shown in FIG. 7 includes many features described previously. In this case however, the illustration shows components of a fuel filling system including fuel filler enclosure 90 with the traditional hinged filler access door 91 attached to a vehicle panel. In this case, the fuel return path is provided utilizing the fuel filling system. In accordance with typical design configuration, gas fill opening 92 communicates with an elongated filler neck 94 which causes fuel being introduced by a gas station fueling nozzle (not shown) to flow into fuel tank 27. In accordance with modern conventional design practices, gas fill opening 92 incorporates a removable filler cap, and/or a flap type valve (not shown) which provide sealing of the interior of filler neck 94. These sealing features are provided to seal the filling system and may also enable vapor recovery system 70 to draw vapor residing within the filler neck 94 (and other components of the filling system) into the vapor recovery system in which vapor is removed or processed. As shown, vapor recovery system 70 incorporates tube 96 communicating with and drawing vapor from filler neck 94. In this embodiment, solenoid valve 72 is provided. In this case however, first fuel conduit 11 incorporates a parallel flow path represented by return tube 98 communicating with filler neck 94 at the three-way T connection 101 at which return tube 98 branches from conduit 11 to connect with a fuel return path. By reference to a "T" connection, it is intended that other physical configurations of such a three-way connection could be utilized including those more readily identified as a "Y" connection i.e. in which two of the flow passages form an acute angle. T connection 101 may be provided with an internal pressure actuated gate valve (not shown) which will direct flow in a manner to be described below. Coiled second conduit 19 may be stored in enclosure 13 which is an optional feature.

Operation of fuel transfer system 1 illustrated in FIG. 7 will be described. During an auxiliary fueling process, fuel transfer system 1 shown in FIG. 7 generally operates in the manner of the prior embodiments. In this case, fuel is directed through valve 72 into second conduit 19 and through nozzle 3. Some mechanism for preventing or at least to restricting the direct flow of fuel flowing through valve 72 into return tube 98 is required. Absent such a feature, fuel would be diverted to flow not only through nozzle 3, but also through return tube 98 where it would drain into filler neck 94. A pressure actuated gate valve could be used at T connection 101 which would flip to a first position closing a flow path to return tube 98 when conduit 11 is pressurized, and flip to a second position opening conduit 11 to return tube 98 when it is not pressurized. Alternatively, a separate solenoid valve 102 could be incorporated which is normally open but it is held closed when system 1 is operated. After an auxiliary fueling process is completed and switch 23 no longer powers the system, solenoid valve 102 would go to a normally open position. Other possible systems could be used such as in venture type fluidic valves which control flow based on pressure and flow without relying upon internal moving components. When a flow path is open into return tube 98, liquid fuel present in conduits 11 and 19 is free to flow to a fuel return path, in this case into filler neck 94 where it drains into the vehicle fuel tank 27 and may be processed by the vapor recovery system 70.

Figure 8:
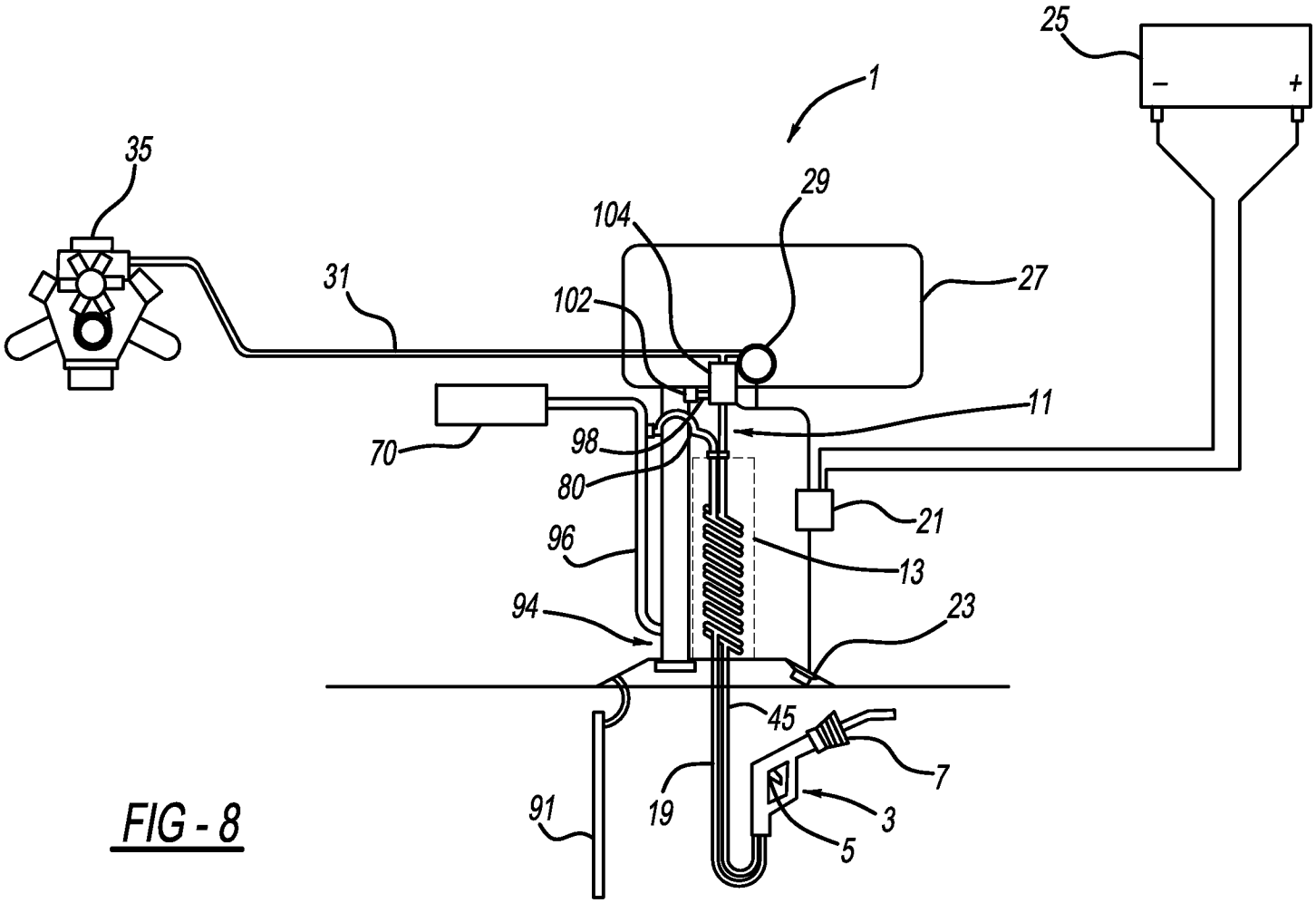
FIG. 8 is a schematic of a fuel transfer system according to a fifth embodiment of the present invention.

Fuel transfer system 1 in accordance with a fifth embodiment of this invention shown in FIG. 8 shares many features of the embodiment illustrated in FIG. 7. In this case however, solenoid valve 72 is replaced with a more capable electrically operated unit which also functions to generate vacuum pressure. In this instance, valve/vacuum pump 104 can be actuated to generate a vacuum to evacuate conduits 11 and 19 after an auxiliary fueling operation is completed. In such instance, fuel is directed into return tube 98 where it drains into filler neck 94 (or another fuel return path) as described previously. For embodiments in which draining of liquid fuel from the system is desired, it may be necessary for an operator to actuate flow control valve 5 to provide venting for the system to permit liquid fuel to the displaced out of the conduits 11 and 19. Other means for providing venting could be provided such as the use of one-way check valves open to atmosphere in the system. However, it has been found that self-venting over time can provide sufficient vapor pressure relief to enable conduits 11 and 19 to be drained without operating a dedicated venting system. Optional solenoid valve 102 can be used if needed to prevent direct flow into the fuel return path when the system 1 is being operated to provide auxiliary fueling.

Figure 9:
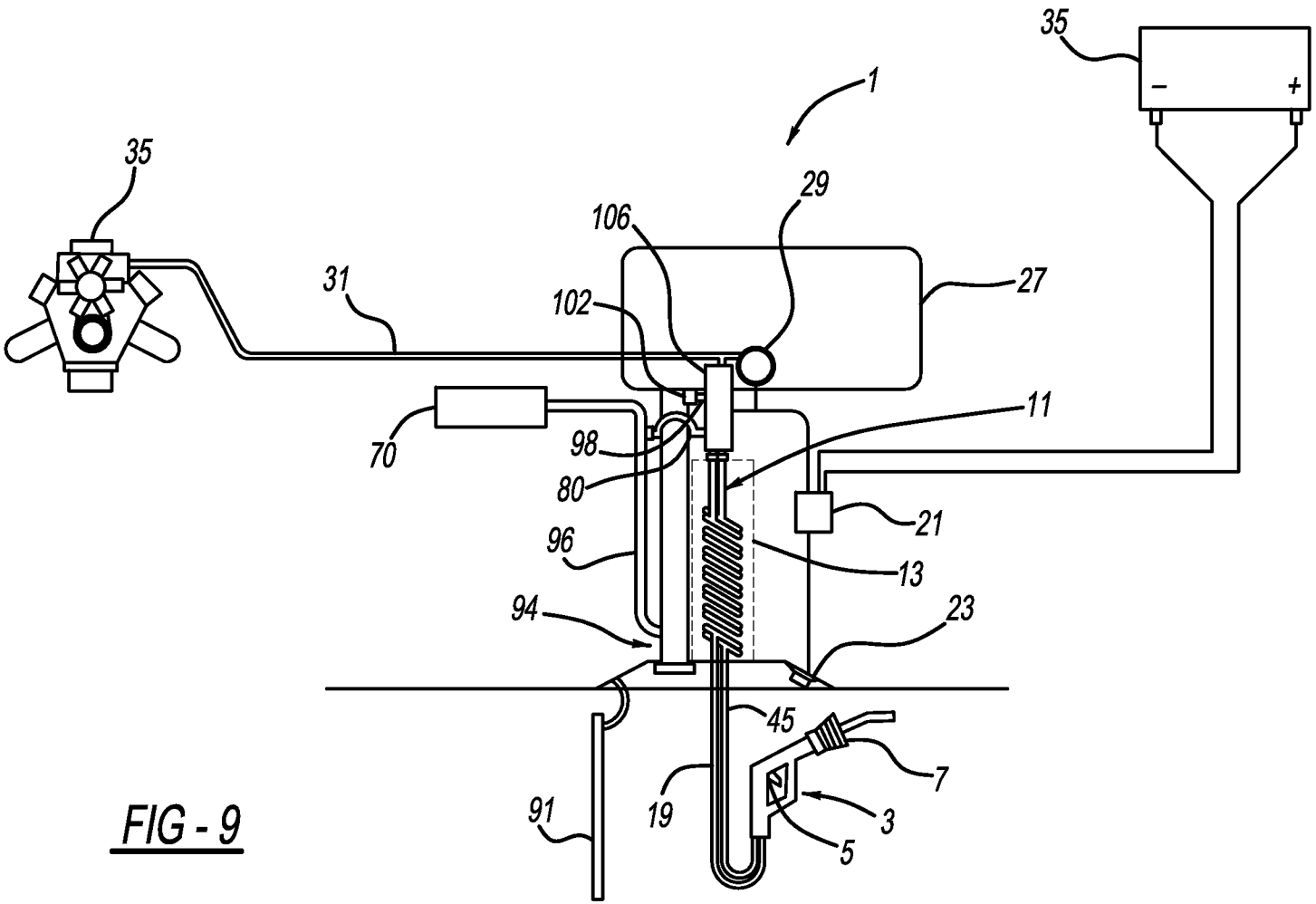
FIG. 9 is a schematic of a fuel transfer system according to a sixth embodiment of the present invention.

Fuel transfer system 1 illustrated in FIG. 9 in accordance with a sixth embodiment of the present invention incorporates a mechanism replacing solenoid valve 72. In this instance, valve/vacuum pump 106 actively evacuates not only liquid fuel within conduits 11 and 19, but further evacuates vapor present in vapor lines 45 and 80. Otherwise, this embodiment operates in the manner of the prior (fifth) described embodiment.

Figure 10:
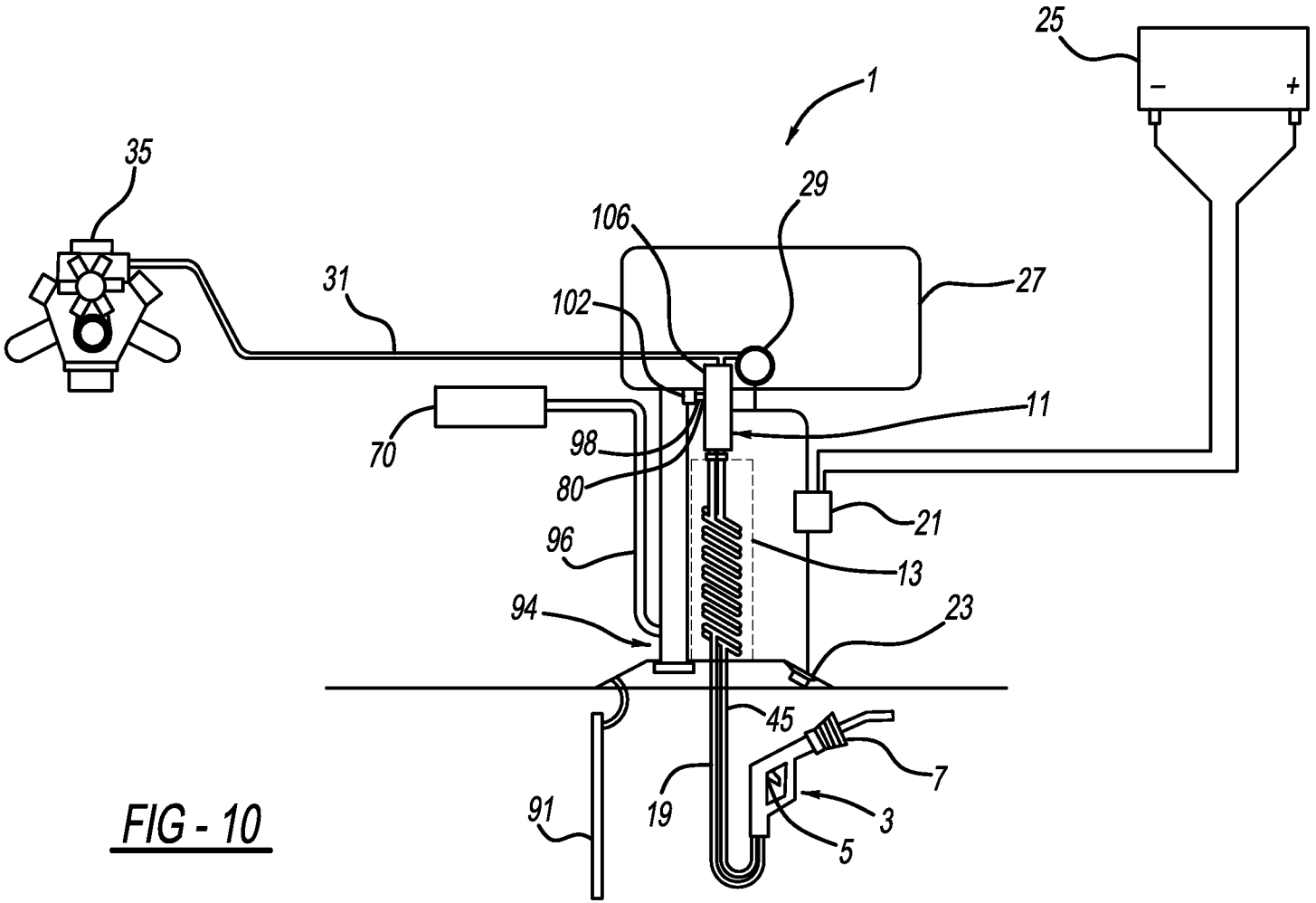
FIG. 10 is a schematic of a fuel transfer system according to a seventh embodiment of the present invention.

Fuel transfer system 1 in accordance with the seventh embodiment of the present invention is illustrated in FIG. 10. In this case valve/vacuum pump 106 directs pumped both liquid fuel and vapor directly into filler neck 94. Vapor line 45 is not otherwise directly connected with factory vapor recovery system 70 (although the filler neck may be connected with the system 70).

Figure 11:
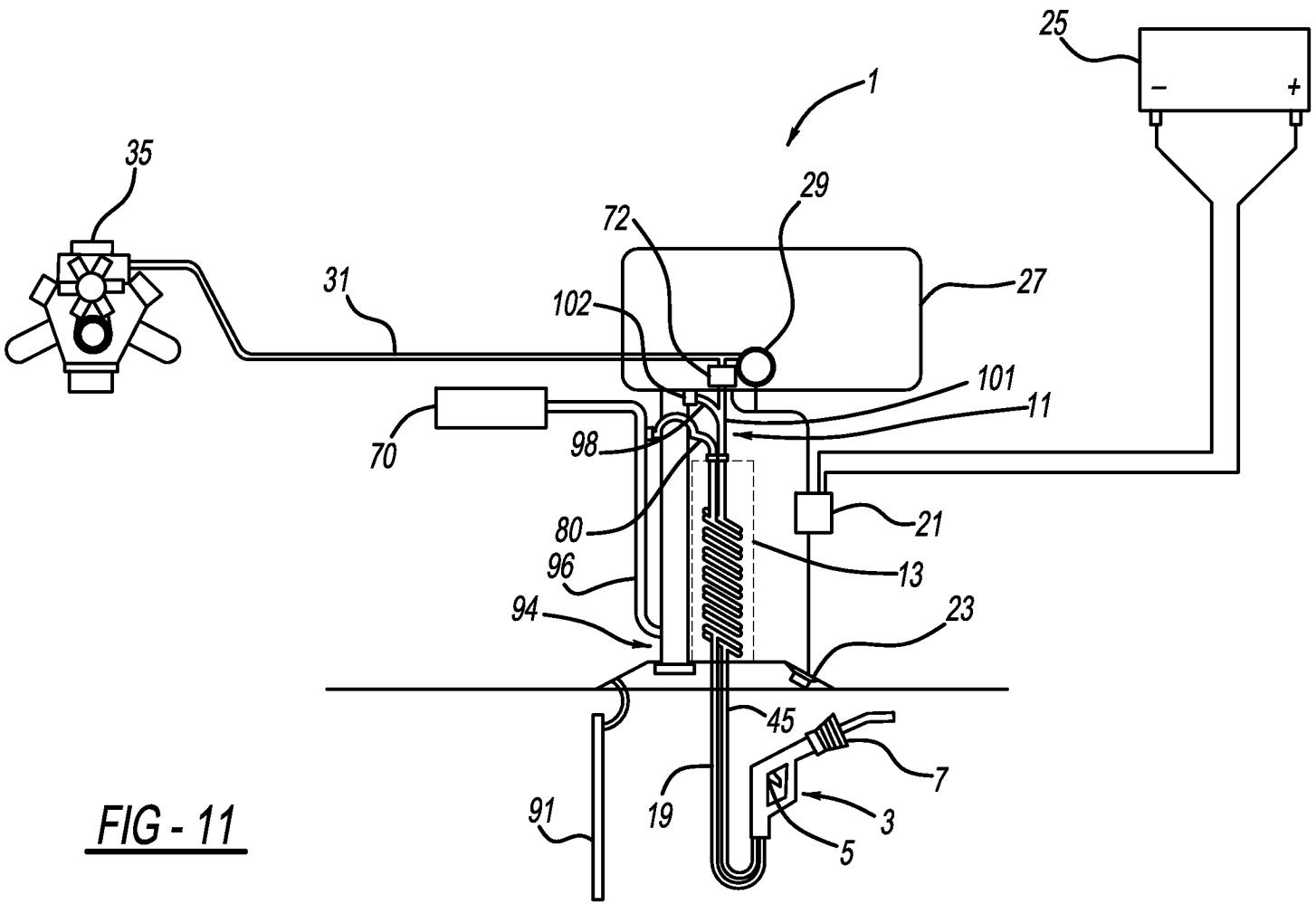
FIG. 11 is a schematic of a fuel transfer system according to an eighth embodiment of the present invention.
Figure 12:
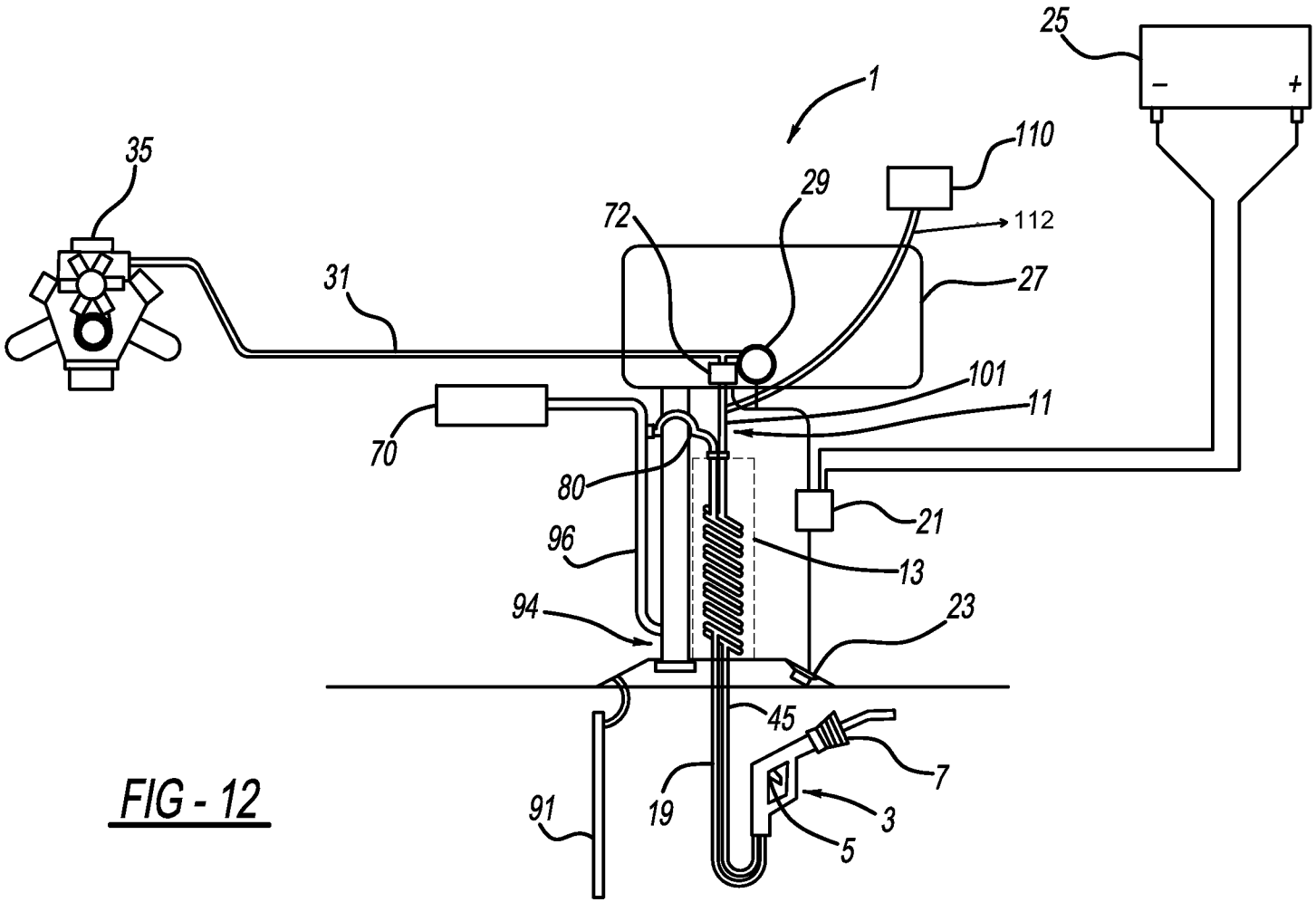
FIG. 12 is a schematic of a fuel transfer system according to a ninth embodiment of the present invention.

Fuel transfer 1 in accordance with an eighth embodiment of the present invention is illustrated in FIG. 11. In this case, the functions of solenoid valve 72 and a vacuum pump 108 are provided as separate units. Preferably, vacuum pump 108 could be mounted within optional enclosure 13. As illustrated, this embodiment features the T connection 101 described with reference to FIG. 7.

In the embodiments of fuel transfer system 1 shown in FIGS. 7 through 11, the return of fuel residing in the system for draining it is caused by reversing the direction of flow of fuel through the system. In other words, during an auxiliary fueling process, fuel is caused to flow from the fuel tank 25 into the system 1 and out of fueling nozzle 3. If it is thereafter desired to drain the system 1 of retained fuel, some mechanism is provided for reversing the direction of flow of liquid fuel from the fueling nozzle 3 back to the fuel tank 27 through some fuel return path, a number of which are described previously. However, there are approaches to providing a draining operation which does not require a separate connection to a fuel return path or require the direction of fuel full flow in the system to reverse. Now with reference to FIG. 12, such a system in accordance with a ninth embodiment of this invention is described. In this embodiment, pump 110 is used which is capable of providing a positive fluid pressure preferably by pumping air from atmosphere into the system 1 when desired. Pump 110 communicates with first fuel conduit 11 at or adjacent to fuel fitting 9. A flexible hose or tube 112 may be provided to make the connection between pump 110 and first fuel conduit 11. During an auxiliary fueling process, pump 110 is not active and the system operates in accordance with the prior embodiments. When it is desired to drain the system of retained fuel, solenoid valve 72 is closed (or a one way check valve or manual valve is provided) and pump 110 is activated to generate a positive gas pressure in conduits 11 and 19. The operator simply places fueling nozzle 3 into gas fill opening 92 (or some other receptacle) and squeezes flow control valve 5 which allows retained liquid fuel in the system to be drained out. The operator will discontinue such draining when only air is escaping from the nozzle 3. In this process fuel flows in only one direction through the system in the fueling and draining operations. Pump 110 can be a small electric motor driven pump similar in scale to small AC powered air pumps used for home aquariums for aeration purposes. When pump 110 is activated, a valve present at fuel fitting 9 or before the connection with the pump and would present prevent back flowing of fuel to the fuel sending unit 29.

In yet another embodiment similar to that described above in connection with FIG. 12., the pump 110 can be replaced by a manual pump, such as the squeeze bulb type found in siphon systems use for training fuel tanks placed in-line in second conduit 19 or as part of the fueling nozzle 3. In operating such as device, after an auxiliary fueling operation fuel flow from the vehicle fuel line 31 would be closed off, some venting at fuel fitting 9 would be provided for example using a one-way check valve or a solenoid operated valve 102 which would allow atmospheric air to enter the system as it is pumped through fueling nozzle 3 to drain the system.

In still another variation, in a draining operation pump 110 could be activated to pump air into the system while the fueling nozzle 3 makes a connection between the second conduit 19 and the vapor recovery tube 45, causing the fuel to be drained by forcing it back to the vapor recovery system through the vapor recovery tube. Further, vapor recovery tube 45 could be replaced by a tube not part of the vapor recovery system and function as just described for returning fuel to the fuel filling system as pump 110 is operated and the tubes in the fueling nozzle 3 are connected.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A fuel transfer system for use with a motor vehicle of the type having a fuel tank and a fuel sending unit for pumping fuel through a fuel line extending from the sending unit to the vehicle's engine, the fuel transfer system allowing fuel in the fuel tank to also be delivered to an auxiliary fuel vessel such as another fuel tank, a fuel container, or an engine powered machine, the fuel transfer system comprising:

a fuel fitting providing a fuel flow path from the fuel sending unit to the fuel transfer system;

at least one fuel conduit connected with the fuel fitting;

a fueling nozzle for delivering the fuel from the fuel fitting, through the at least one conduit, and to the auxiliary fuel vessel;

a nozzle valve incorporated in the fueling nozzle for controlling delivery of the fuel through the fueling nozzle when the system is operated for delivering fuel to the auxiliary vessel; and a return connection bypassing the fuel line and the vehicle engine and connecting the at least one fuel conduit with a fuel return path communicating with the fuel tank of the motor vehicle for enabling liquid fuel present in the at least one fuel conduit to be drained into the fuel return path when the system is not operated to supply fuel to the auxiliary vessel.

2. The fuel transfer system of claim 1, further comprising that the at least one fuel conduit has a first fuel conduit connected with the fuel fitting; and a second fuel conduit in the form of a flexible tube connected with the first fuel conduit and the fueling nozzle.

3. The fuel transfer system of claim 1, further comprising that the at least one fuel conduit is in the form of a first fuel conduit and a flexible second fuel conduit, and an enclosure for enclosing at least a portion of the second fuel conduit.

4. The fuel transfer system of claim 3 further comprising that the enclosure enables storage of the fueling nozzle.

5. The fuel transfer system of claim 1, wherein the fuel fitting is a T-fitting that makes a three way connection among a first portion of the fuel line communicating with the engine, a second portion of the fuel line coupled to the fuel sending unit, and the at least one fuel conduit.

6. The fuel transfer system of claim 1 wherein the vehicle has a vapor recovery system and further comprising a vapor line communicating the vehicle vapor recovery system and the fueling nozzle for directing vapor collected at the nozzle to flow into the vehicle vapor recovery system.

7. The fuel transfer system of claim 6 further comprising a vacuum pump communicating with the vapor line for pumping vapor in the vapor line into the vapor recovery system.

8. The fuel transfer system of claim 3, further comprising an enclosure for containing the second fuel conduit when the second fuel conduit is not extended for use in fueling the auxiliary fuel vessel.

9. The fuel transfer system of claim 1, further comprising:

a control panel adapted to be mounted to the vehicle having an on-off switch connected to the vehicle's power supply and the fuel sending unit for providing electrical power to the fuel sending unit when the vehicle's engine is not running.

10. A fuel transfer system for use with a motor vehicle of the type having a fuel tank and a fuel sending unit for pumping fuel thorough a fuel line to the vehicle's engine, the fuel transfer system allowing fuel in the fuel tank to also be delivered to an auxiliary fuel vessel such as another fuel tank, a fuel container, or an engine powered machine, the fuel transfer system comprising:

a fuel fitting providing a fuel flow path from the fuel sending unit to the fuel transfer system;

at least one fuel conduit connected with the fuel fitting;

a fueling nozzle for delivering the fuel from the fuel fitting, through the at least one conduit, and to the auxiliary fuel vessel;

a nozzle valve incorporated in the fueling nozzle for controlling delivery of the fuel through the fueling nozzle when the system is operated for delivering fuel to the auxiliary vessel; and a return connection communicating with the at least one fuel conduit and a fuel return path communicating with the fuel tank of the motor vehicle for enabling liquid fuel present in the at least one fuel conduit to be drained into the fuel return path when the system is not operated to supply fuel to the auxiliary vessel, wherein the motor vehicle further has a fuel filler system for enabling the supply of fuel to the fuel tank, and the fuel return path is provided at least in part by the fuel filler system.

11. The fuel transfer system of claim 10, further comprising that the fuel filler system has a fuel filler neck with the return connection communicating with the fuel filler neck for draining the fuel into the fuel filler neck.

12. A fuel transfer system for use with a motor vehicle of the type having a fuel tank and a fuel sending unit for pumping fuel thorough a fuel line to the vehicle's engine, the fuel transfer system allowing fuel in the fuel tank to also be delivered to an auxiliary fuel vessel such as another fuel tank, a fuel container, or an engine powered machine, the fuel transfer system comprising:

a fuel fitting providing a fuel flow path from the fuel sending unit to the fuel transfer system;

at least one fuel conduit connected with the fuel fitting;

a fueling nozzle for delivering the fuel from the fuel fitting, through the at least one conduit, and to the auxiliary fuel vessel;

a nozzle valve incorporated in the fueling nozzle for controlling delivery of the fuel through the fueling nozzle when the system is operated for delivering fuel to the auxiliary vessel; and a return connection communicating with the at least one fuel conduit and a fuel return path communicating with the fuel tank of the motor vehicle for enabling liquid fuel present in the at least one fuel conduit to be drained into the fuel return path when the system is not operated to supply fuel to the auxiliary vessel, further comprising a first fuel valve for controlling the flow of fuel from the fuel line to the fuel transfer system and the nozzle valve incorporated into the fueling nozzle is a second fuel valve with the return connection placed between the first fuel valve and the second fuel valve.

13. The fuel transfer system of claim 12, wherein the first fuel valve is integrated with or positioned adjacent to the fuel fitting.

14. The fuel transfer system of claim 12, wherein the return connection is connected with the at least one conduit connected by a "T" connection positioned between the first fuel valve and the second fuel valve.

15. The fuel transfer system of claim 14, further comprising that the T connection incorporates a third fuel valve for selectively providing a connection for transmitting fuel through the at least one fuel conduit to the nozzle, and providing a connection between the at least one conduit and the return connection for draining the at least one conduit.

16. The fuel transfer system of claim 15, further comprising that the third fuel valve is in the form of a solenoid operated valve.

17. The fuel transfer system of claim 12, further comprising a vacuum pump communicating with the at least one fuel conduit for pumping liquid fuel present in the at least one conduit into the fuel return path.

18. The fuel transfer system of claim 17, wherein the first fuel valve is a solenoid operated valve, and wherein the fueling nozzle includes an electric switch for activating the solenoid operated valve to open during the supply of fuel to the fuel transfer system and closing upon the completion of the supply of the fuel and for activating the vacuum pump when the solenoid operated valve is closed to initiate draining of the fuel transfer system.

19. The fuel transfer system of claim 17, further comprising that the vacuum pump and the first fuel valve are provided as separate units.

20. The fuel transfer system of claim 17, further comprising that the vacuum pump and the first fuel valve are provided as integrated units.

21. A fuel transfer system for use with a motor vehicle of the type having a fuel tank and a fuel sending unit for pumping fuel thorough a fuel line to the vehicle's engine, the fuel transfer system allowing fuel in the fuel tank to also be delivered to an auxiliary fuel vessel such as another fuel tank, a fuel container, or an engine powered machine, the fuel transfer system comprising:

a fuel fitting in the fuel line providing a fuel flow path from the fuel line to the fuel transfer system;

at least one fuel conduit connected with the fuel fitting;

a fueling nozzle for delivering the fuel from the fuel fitting, through the at least one conduit, and to the auxiliary fuel vessel;

a nozzle valve incorporated in the fueling nozzle for controlling delivery of the fuel through the fueling nozzle when the system is operated for delivering fuel to the auxiliary vessel; and a pump communicating with the at least one fuel conduit for producing a positive gas pressure in the at least one conduit for causing liquid fuel present in the at least one fuel conduit and the fueling nozzle to be drained after the system is operated to supply fuel to the auxiliary vessel as the fuel is replaced by a gas.

22. The fuel transfer system of claim 21, further comprising that the pump is in the form of an air pump for supplying air to the at least one conduit.

23. The fuel transfer system of claim 21, further comprising that the pump is connected with the at least one conduit at or adjacent to the fuel fitting.

24. The fuel transfer system of claim 21, further comprising that the at least one fuel conduit includes a first fuel conduit connected with the fuel fitting; and a second fuel conduit in the form of a flexible tube connected with the first fuel conduit and the fueling nozzle.

25. The fuel transfer system of claim 21, further comprising a first fuel valve for controlling the flow of fuel from the fuel line to the fuel transfer system, wherein the nozzle valve incorporated into the fueling nozzle includes a second fuel valve, wherein the pump connected with the at least one conduit is disposed between the first fuel valve and the second fuel valve.

26. The fuel transfer system of claim 25, further comprising that the first fuel valve is integrated with or positioned adjacent to the fuel fitting.

27. The fuel transfer system of claim 21 further comprising that the pump is connected with the at least one conduit connected by a "T" connection positioned between the first and second valves.

28. The fuel transfer system of claim 21 further comprising a first fuel valve in the form of a solenoid operated valve, and wherein the nozzle valve incorporated into the fueling nozzle comprising a second fuel valve, an electric switch for activating the solenoid operated valve to open during the supply of fuel to the fuel transfer system and closing upon the completion of the supply of the fuel and for activating the pump when the solenoid valve is closed to initiate draining supply system.

29. The fuel transfer system of claim 21, wherein the fuel fitting is a T-fitting that makes a three-way connection among the fuel line communicating with the engine, the fuel line coupled to the fuel sending unit, and the at least one fuel conduit.

30. The fuel transfer system of claim 21 wherein the vehicle has a vapor recovery system and further includes a vapor line communicating the vehicle vapor recovery system and the fueling nozzle for directing vapor collected at the nozzle to flow into the vehicle vapor recovery system , the fueling nozzle connecting the at least one fuel line to the vapor recovery line for enabling fuel in the at least one fuel line to flow into the vapor recovery line when the pump is activated for draining the system of fuel.

31. A fuel transfer system for use with a motor vehicle of the type having a fuel tank and a fuel sending unit for pumping fuel thorough a fuel line to the vehicle's engine, the fuel transfer system allowing fuel in the fuel tank to also be delivered to an auxiliary fuel vessel such as another fuel tank, a fuel container, or an engine powered machine, the fuel transfer system comprising:

a fuel fitting providing a fuel flow path from the fuel sending unit to the fuel transfer system;

at least one fuel conduit connected with the fuel fitting;

a fueling nozzle for delivering the fuel from the fuel fitting, through the at least one conduit, and to the auxiliary fuel vessel;

a nozzle valve incorporated in the fueling nozzle for controlling delivery of the fuel through the fueling nozzle when the system is operated for delivering fuel to the auxiliary vessel; and a return connection communicating with the at least one fuel conduit and a fuel return path communicating with the fuel tank of the motor vehicle for enabling liquid fuel present in the at least one fuel conduit to be drained into the fuel return path when the system is not operated to supply fuel to the auxiliary vessel, further comprising an on-off switch adapted to be mounted to the vehicle, the on-off switch connected to the vehicle's power supply and the fuel sending unit for providing electrical power to the fuel sending unit when the vehicle's engine is not running enabling fuel to be supplied to the fuel transfer system.

* * * * *